US010400468B2

(12) United States Patent
Beard

(10) Patent No.: US 10,400,468 B2
(45) Date of Patent: Sep. 3, 2019

(54) STAGGERED TRUSS SYSTEM WITH CONTROLLED FORCE SLIP JOINTS

(71) Applicant: Scott Randall Beard, Indianola, WA (US)

(72) Inventor: Scott Randall Beard, Indianola, WA (US)

( * ) Notice: Subject to any disclaimer, the term of this patent is extended or adjusted under 35 U.S.C. 154(b) by 0 days.

(21) Appl. No.: 15/288,954

(22) Filed: Oct. 7, 2016

(65) Prior Publication Data

US 2017/0204629 A1 Jul. 20, 2017

Related U.S. Application Data

(63) Continuation of application No. 14/388,772, filed as application No. PCT/US2013/034438 on Mar. 28, 2013, now abandoned.

(60) Provisional application No. 61/616,563, filed on Mar. 28, 2012.

(51) Int. Cl.

| | |
|---|---|
| ***E04H 9/02*** | (2006.01) |
| ***E04B 1/24*** | (2006.01) |
| ***E04B 1/36*** | (2006.01) |
| ***E04B 1/98*** | (2006.01) |
| ***E04C 3/08*** | (2006.01) |
| *E04C 3/04* | (2006.01) |

(52) U.S. Cl.

CPC ..... *E04H 9/024* (2013.01); *E04B 1/24* (2013.01); *E04B 1/2403* (2013.01); *E04B 1/36* (2013.01); *E04B 1/98* (2013.01); *E04C 3/08* (2013.01); *E04H 9/021* (2013.01); *E04H 9/027* (2013.01); *E04H 9/028* (2013.01); *E04B 2001/2415* (2013.01); *E04B 2001/2418* (2013.01); *E04B 2001/2439* (2013.01); *E04B 2001/2448* (2013.01); *E04B 2001/2496* (2013.01); *E04C 2003/0491* (2013.01)

(58) Field of Classification Search

CPC ..... Y10T 403/39; Y10T 403/3913; Y10T 403/33; Y10T 403/4691; Y10T 403/75; Y10T 403/21; E04H 9/021; E04H 9/024; E04H 9/027; E04H 9/028; E04H 2001/24; E04C 3/08; E04C 2003/0491; E04C 2001/2448; E04B 1/2403; E04B 1/98; E04B 1/36; E04B 1/24; E04B 2001/2448; E04B 2001/24

USPC ..... 52/167.1, 167.3, 573.1; 403/187, 189, 403/167, 262, 408.1, 28

See application file for complete search history.

(56) References Cited

U.S. PATENT DOCUMENTS 4,409,765 A * 10/1983 Pall ..... E04B 1/2403 52/167.1
5,845,438 A * 12/1998 Haskell ..... E04H 9/02 52/167.1
6,308,469 B1 * 10/2001 Leung ..... E04B 1/10 411/466
6,799,406 B2 * 10/2004 Gosselin ..... B21D 47/04 52/694

(Continued)

*Primary Examiner* — Brian E Glessner
*Assistant Examiner* — Adam G Barlow
(74) *Attorney, Agent, or Firm* — Christensen O'Connor Johnson Kindness PLLC

(57) ABSTRACT

A truss for use in a staggered truss system in provided. The truss includes at least one slip joint for allowing relative movement between the top chord of the truss and the bottom chord of the truss. The staggered truss system may be suitable for use in seismic regions.

12 Claims, 10 Drawing Sheets

(56) References Cited

U.S. PATENT DOCUMENTS

2008/0289267 A1* 11/2008 Sarkisian ..... E04H 9/02
52/167.3
2012/0038091 A1* 2/2012 Tagawa ..... E04H 9/021
267/136

* cited by examiner

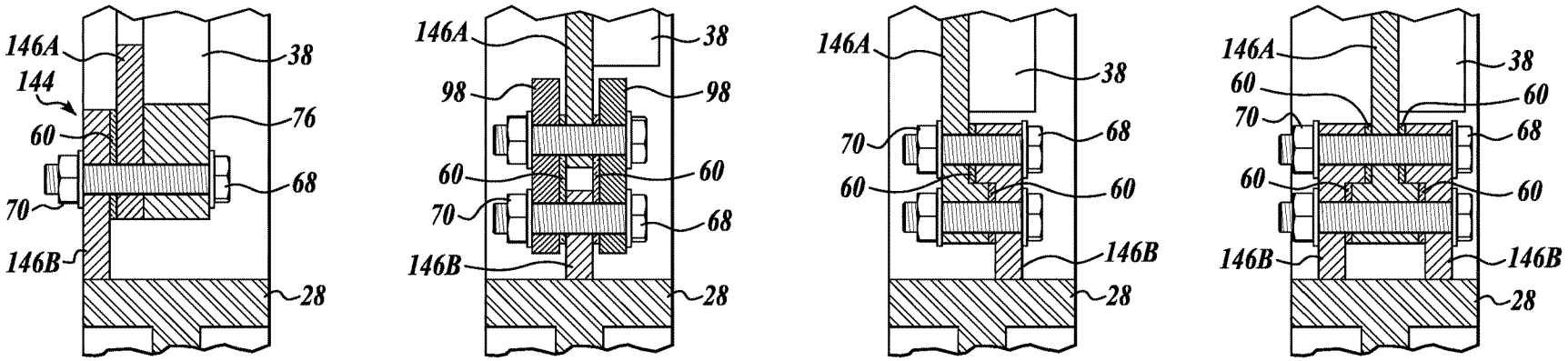
Fig. 7a.
Fig. 7b.
Fig. 7c.
Fig. 7d.
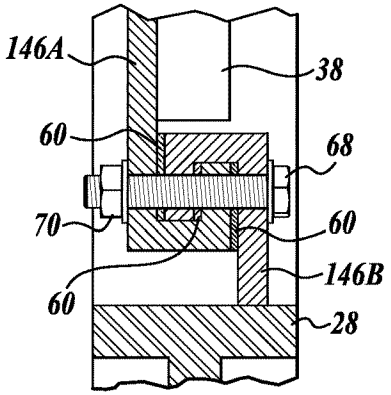
Fig. 7e.
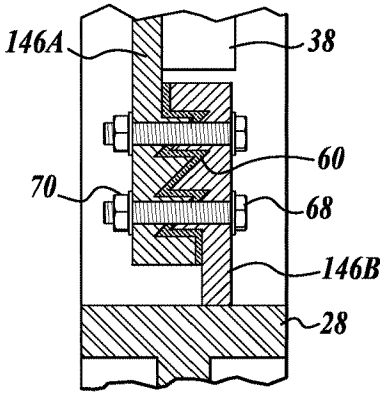
Fig. 7f.
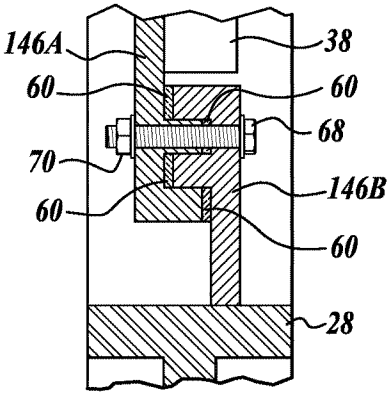
Fig. 7g.

STAGGERED TRUSS SYSTEM WITH CONTROLLED FORCE SLIP JOINTS

CROSS-REFERENCE TO RELATED APPLICATION

This application is a continuation of U.S. application Ser. No. 14/388,772, filed Sep. 26, 2014, which is the National Stage of International Application No. PCT/US2013/034438, filed Mar. 28, 2013, which claims the benefit of U.S. Provisional Application No. 61/616,563, filed Mar. 28, 2012, all the disclosures of which are hereby incorporated by reference.

BACKGROUND

The conventional Staggered Steel Truss System (SSTS) originated as a design project at MIT in the 1960s. SSTS is a framing system in which the floor girders are full story depth trusses, and are buried in the walls. It gets its name from staggering the trusses at each floor level so that the floor planks are supported by the top chord of a truss at one end, but the bottom chord of an adjacent truss at the other end, as best shown in FIG. 11. For more explanation of an SSTS, please see the paper entitled "Staggered Truss Framing System in Areas of Moderate-High Seismic Hazard," by Kevin S. Moore, in the 2005 NASCC Proceedings, San Antonio, Tex., February 8-11. The disclosure of this paper is hereby incorporated by reference in its entirety.

SSTS was originally thought to be a good seismic performer, and as a result, a number of these types of building were built. Further analysis later showed that they present a seismic hazard. In ordinary buildings, the vertical and lateral bracing are different systems. In SSTS, however, the truss members are both bracing members and vertical support members. The normal yielding and buckling of braces used to dissipate seismic energy could cause vertical collapse. Notification when out to the design community in 2005. Since that time, no staggered steel truss buildings have been built in high seismic areas.

Recently, much research has been done in trying to create a SSTS building that would provide good seismic performance. So far all of the attempts have focused on the center panels of the trusses based on know designs of a system called the Special Ductile Truss System (SDTS), which is know to be very seismically robust. A SDTS concentrates all of the yielding and buckling of the system in the center panel. One difference between SSTS and the SDTS is that SSTS employs full floor-to-floor depth trusses and the SDTS does not. Please see the presentation entitled "Challenges of Using Steel Staggered Truss Framing Systems in High Seismic Regions: Behavior, Issues, and Possible Solutions" presented by Shih-Ho Chao, Assistant Professor of Civil Engineering, University of Texas, Arlington, at the Quake Summit, NEES and MCEER Annual Meeting, Buffalo, N.Y., Jun. 10, 2011. The disclosure of this presentation is hereby incorporated by reference in its entirety.

SUMMARY

Rather than protecting the staggered trusses by allowing yielding in the center panels, embodiments of the present disclosure utilize a controlled force slip joint to allow the floors to slip relative to each other, when the load, such as a seismic load, gets above a set amount. The slip joints are designed to preserve vertical load transfer even during and after slippage. Essentially, the staggered trusses in some embodiments of the present disclosures turn into a damped moment frame operating in the plastic load region, beyond a certain load.

Embodiments of the present disclosure may find many applications, including buildings that desire excellent seismic performance when employing staggered truss systems, such as staggered steel truss systems. Other applications include buildings that desire a measure of wind damping. In these applications, the slip load may be adjusted to a lower load level, providing a general seismic/wind damping system.

In accordance with aspects of the present disclosure, a truss is provided for use in a staggered truss system. The truss comprises a top chord extending in a first direction, a bottom chord spaced from the top chord and extending in parallel with the top chord, at least one vertical web member positioned between the top and bottom chord, and at least one diagonal web member positioned between the top and bottom chord. The truss includes at least one slip joint positioned at the interface of the top chord and the at least one vertical web member. In some embodiments, the slip joint is configured to connect the top chord to the at least one vertical web member in a manner that prohibits relative movement between the top chord and the vertical web member when a lateral load less than a preselected value is applied while allowing relative movement between the top chord and the vertical web member along the first direction when a lateral load greater than a preselected value is applied.

In accordance with another aspect of the present disclosure, a truss is provided for use in a staggered truss system. The truss includes a top chord extending in a first direction, a bottom chord spaced from the top chord and extending in parallel with the top chord, at least one vertical web member positioned between the top and bottom chord, at least one diagonal web member positioned between the top and bottom chord, and at least one slip joint positioned at the interface of the top chord and the at least one vertical web member. In some embodiments, the slip joint includes an attachment plate secured to the top of the vertical web member. The attachment plate is positioned underneath a section of the top chord. The slip joint also includes a shim positioned between the attachment plate and the section of the top chord. In some embodiments, the shim includes a plurality of slots elongated in the first direction. The slip joint further includes a fastener arrangement configured to connect the top chord to the attachment plate. In some embodiments, one of the attachment plate and the section of the top chord include a plurality of slots generally sized and aligned with the slots of the shims and the other of the plate and the section of the top chord includes a plurality of holes. The fastener arrangement in some embodiments includes a bolt that extends through the generally aligned slots and the holes and a nut that affixes the bolt in place.

In accordance with another aspect of the present disclosure, a truss is provided for use in a staggered steel truss system. The truss includes a top chord extending in a first direction, a bottom chord spaced from the top chord and extending in parallel with the top chord, at least one vertical web member positioned between the top and bottom chord, at least one diagonal web member positioned between the top and bottom chord, and means for connecting one of the top chord and the bottom chord to the at least one vertical web member in a manner that allows slip between the vertical web member and said one of the top chord and the bottom chord along the first direction when a lateral load greater than a preselected value is applied.

In accordance with another aspect of the present disclosure, a truss is provided for use in a staggered truss system. The truss includes a top chord extending in a first direction, a bottom chord spaced from the top chord and extending in parallel with the top chord, at least one vertical web member positioned between the top and bottom chord, at least one diagonal web member positioned between the top and bottom chord, and at least one slip joint positioned at the interface of the bottom chord and the at least one vertical web member. In some embodiments, the slip joint is configured to connect the bottom chord to the at least one vertical web member in a manner that prohibits relative movement between the bottom chord and the vertical web member when a lateral load less than a preselected value is applied while allowing relative movement between the bottom chord and the vertical web member along the first direction when a lateral load greater than a preselected value is applied.

In accordance with another aspect of the present disclosure, a staggered truss system is provided. The system includes three or more trusses positioned in a staggered orientation. Each truss in the system includes a bottom chord spaced from the top chord and extending in parallel with the top chord, at least one vertical web member positioned between the top and bottom chord, at least one diagonal web member positioned between the top and bottom chord, and at least one slip joint positioned at the interface of the bottom chord and the at least one vertical web member. The slip joint is some embodiments is configured to connect the bottom chord to the at least one vertical web member in a manner that allows slip between the bottom chord and the vertical web member along the first direction when a lateral load greater than a preselected value is applied.

In accordance with another aspect of the present disclosure, a staggered truss system is provided. The system includes three or more trusses positioned in a staggered orientation. Each truss in the system includes a top chord extending in a first direction, a bottom chord spaced from the top chord and extending in parallel with the top chord, at least one vertical web member positioned between the top and bottom chord, at least one diagonal web member positioned between the top and bottom chord, and at least one slip joint positioned at the interface of the top chord and the at least one vertical web member. The slip joint in some embodiments is configured to connect the top chord to the at least one vertical web member while allowing slip between the top chord and the vertical web member along the first direction when a lateral load greater than a preselected value is applied.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIGS. 7A-7G are sectional views of several examples of slip joints that may be practiced with one or more trusses of the present disclosure;

DETAILED DESCRIPTION

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

Figure 1:
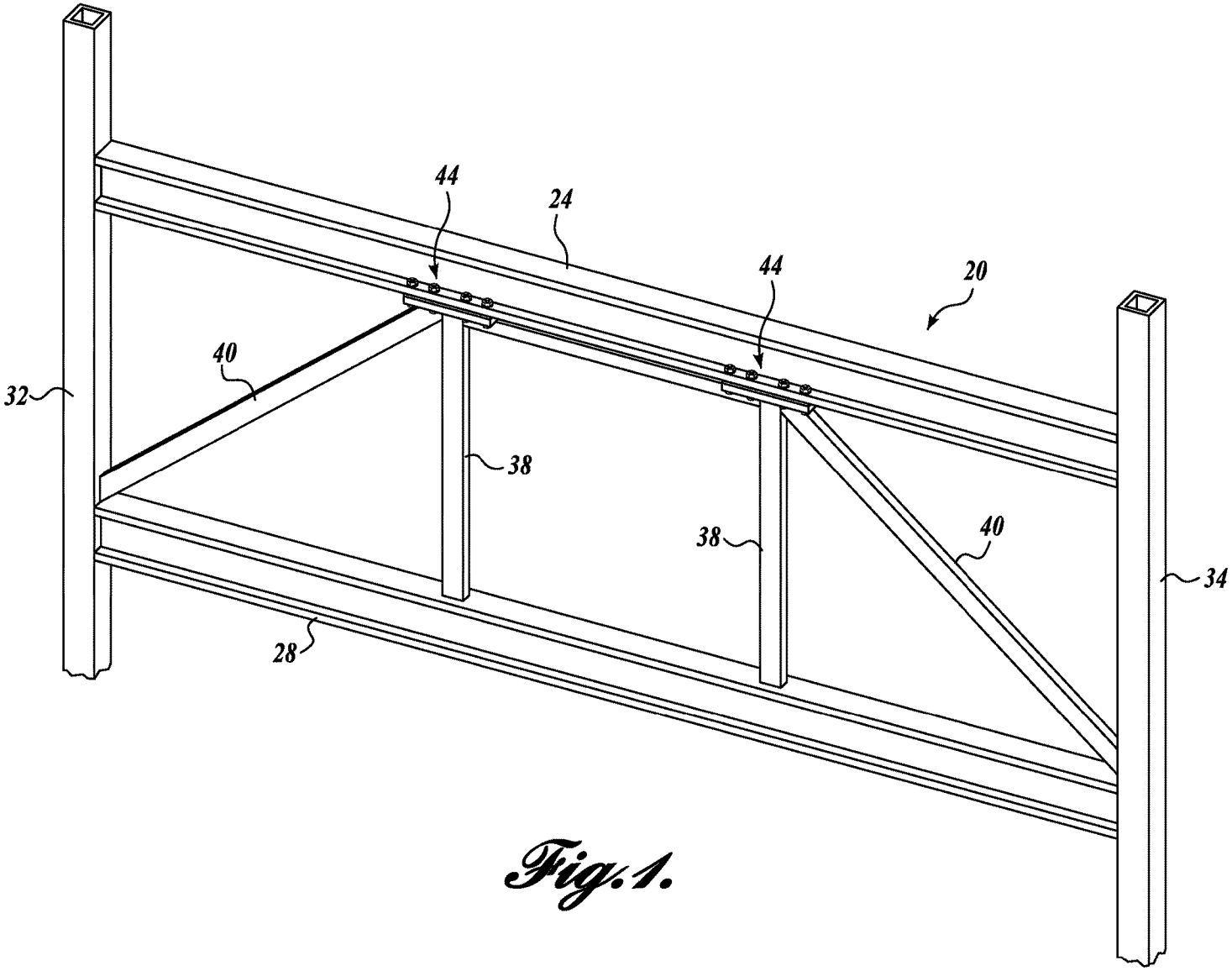
FIG. 1 is a perspective view of one example of a truss formed in accordance with aspects of the present disclosure.
Figure 2:
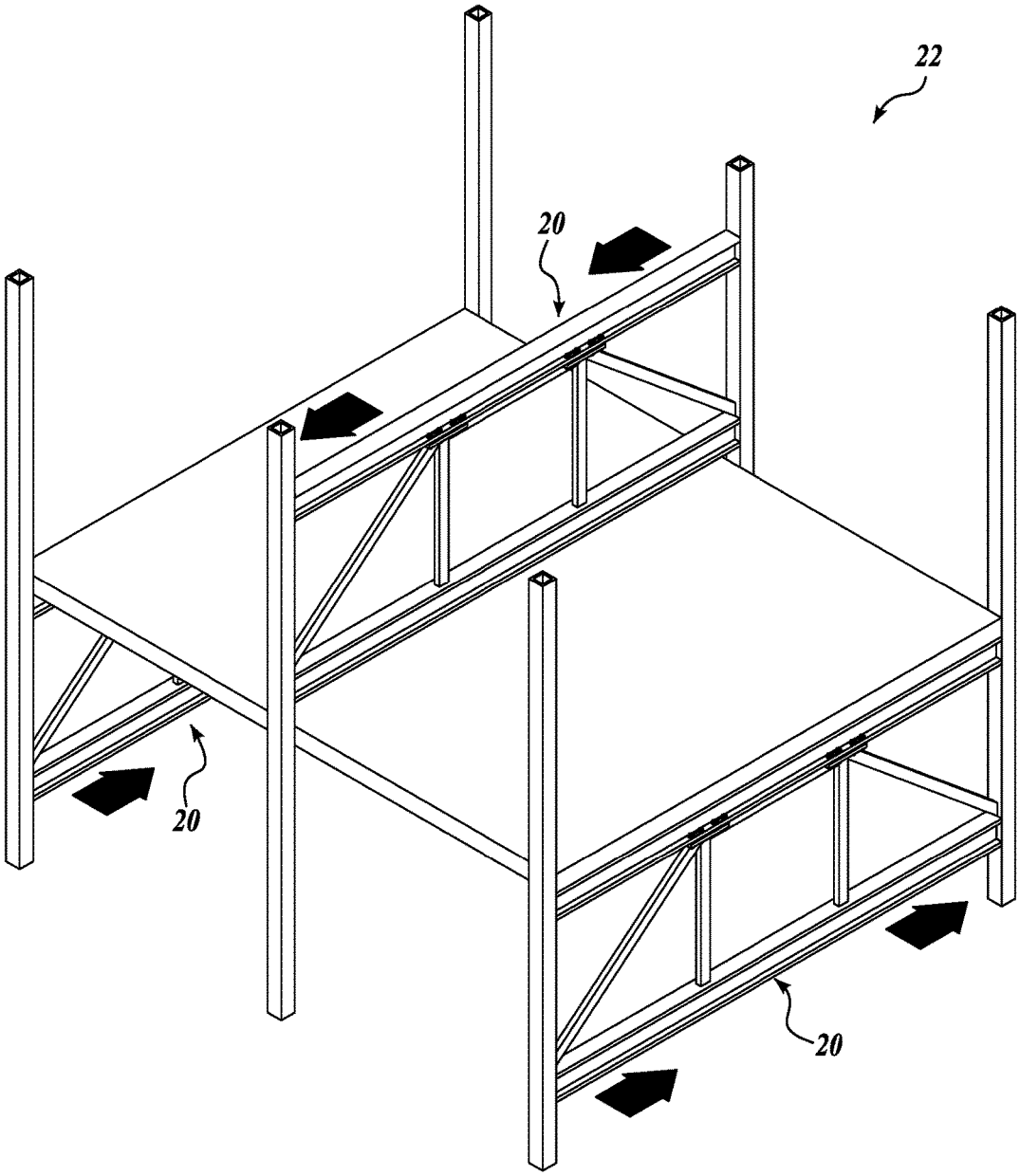
FIG. 2 is a multi-story STS, such as a SSTS, employing a plurality of trusses of FIG. 1.

FIG. 1 illustrates a perspective view of one example of a truss, generally designated 20, according to aspects of the present disclosure. One or more trusses 20 are suitable for use in a Staggered Truss System (STS), such as Staggered Steel Truss System (SSTS) 22, a part of which is shown in FIG. 2. As best shown in FIG. 1, the truss 20 includes parallely orientated top and bottom chords 24 and 28 that span between first and second vertical exterior beams 32 and 34, and a web comprising one or more vertical members 38 and one or more diagonal members 40. As will be described in more detail below, the truss 20 includes a slip joint 44 at one or more of the intersections of the vertical and diagonal web members 38 and 40, and the top chord 24, for providing relative movement or "slip" between the top and bottom chords when the load exceeds a preselected amount.

Figure 3A:
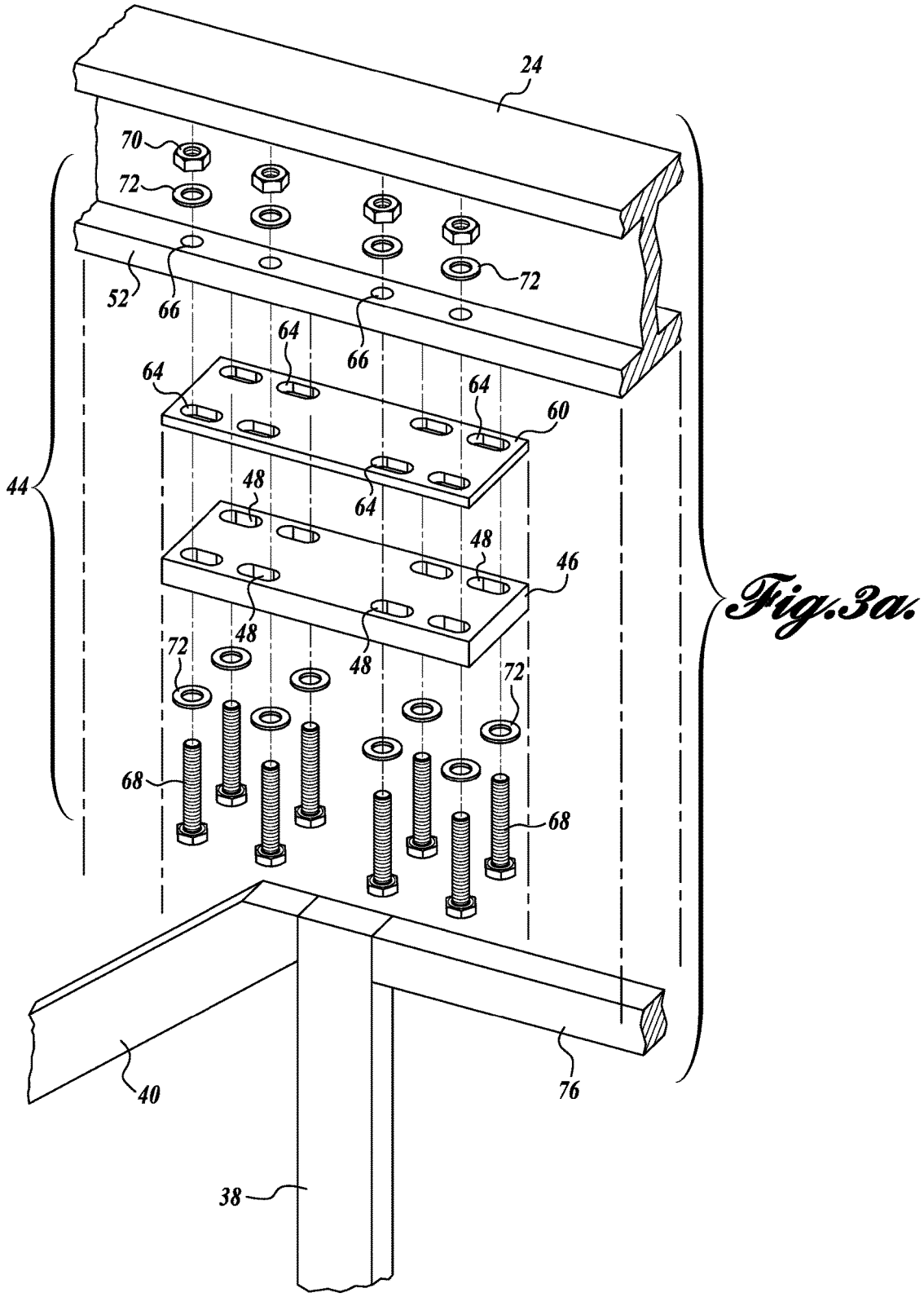
FIGS. 3A and 3B are partial exploded views of representative embodiments of slip joints suitable for use with the truss of FIG. 1.
Figure 4:
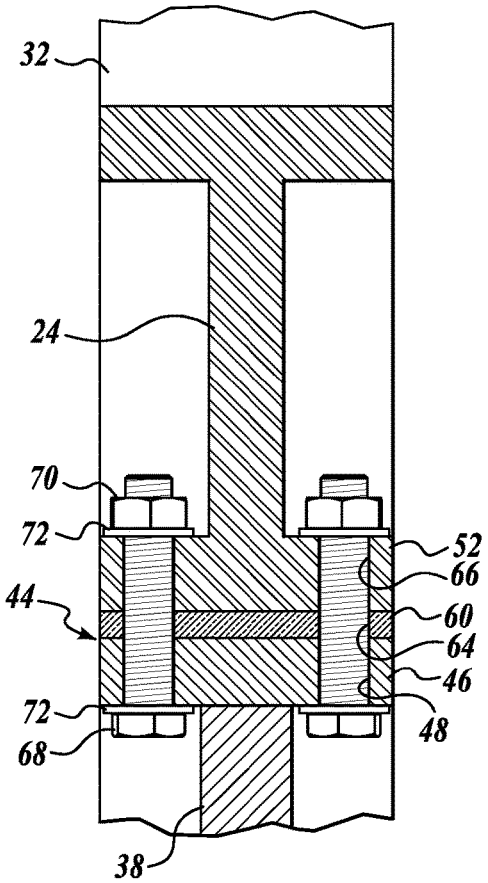
FIG. 4 is a cross-sectional view of the slip joint of FIG. 3.

Turning now to FIGS. 3A and 4, one example of the slip joint 44 will be described in more detail. As best shown in FIG. 3A, an attachment plate 46 is welded or otherwise fixedly attached to the top of the vertical web member 38. In some embodiments, the attachment plate 46 is generally rectangular in shape and is sized to extend past the top lateral edges of the vertical web member 38. In the lateral regions of the attachment plate, sets of laterally oriented, slotted holes 48 are provided. The top chord 24, shown as an I-beam in the example of FIG. 3A, is supported by the attachment plate 46, as shown in FIG. 4, and includes a beam flange 52 having sets of holes 66. A piece of shim 60 is disposed in-between the beam flange 52 of the top chord 24 and the attachment plate 46. The shim 60 includes corresponding slotted holes 64, which are aligned with the slotted holes 48 of the attachment plate 46 and the holes 66 of the beam flange 52. A fastener arrangement of bolts 68, nuts 70, and optional washers 72 are inserted through slotted holes 46 and 64, and holes 66 in order to connect the top chord 24 to the attachment plate 46.

Figure 3B:
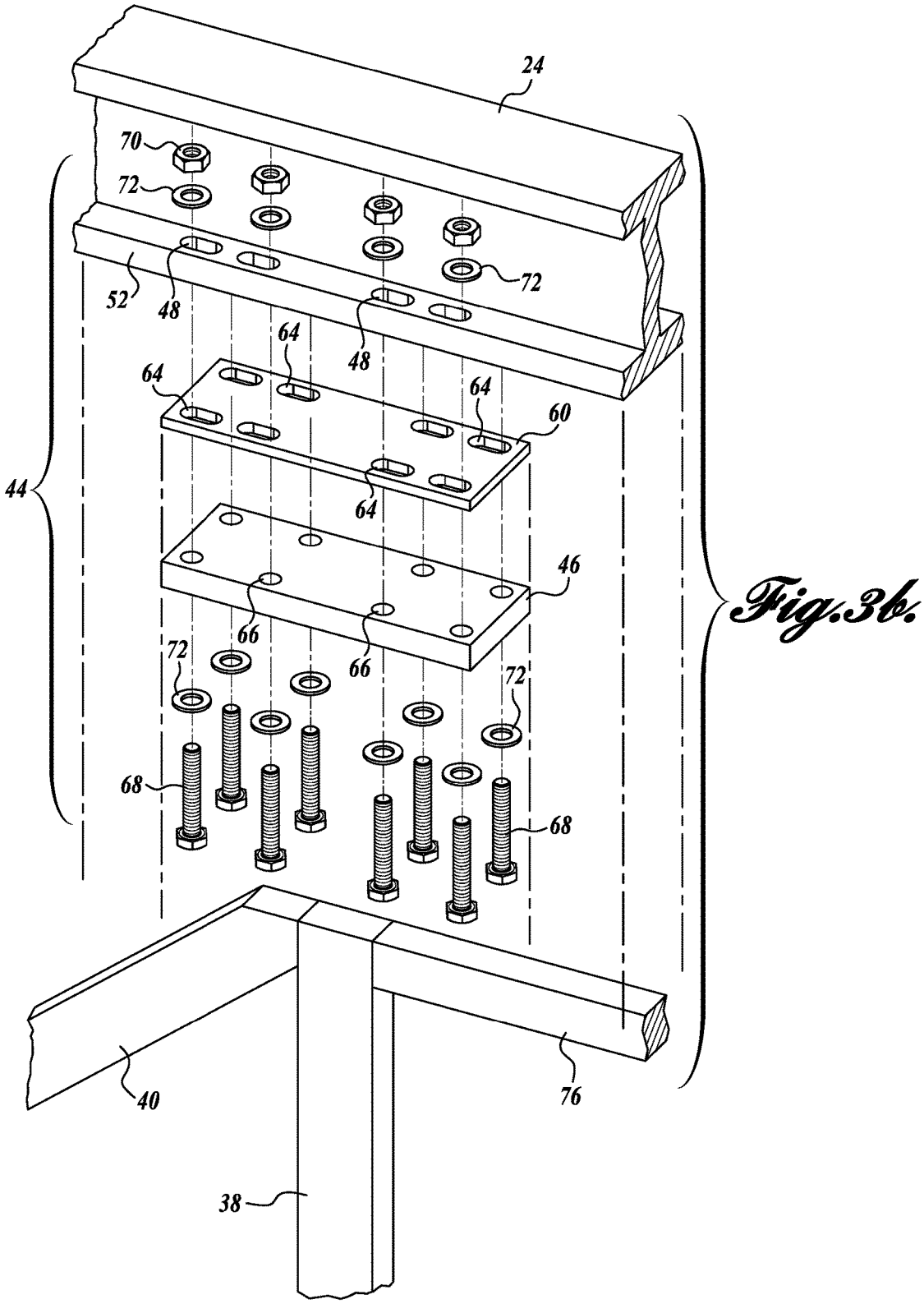

When assembled, the tension placed on the bolts 68 can be selected to work with the coefficient of friction in the shim 60 so that the attachment plate 46 is prohibited to move relative to the top chord when an applied lateral load is less than a preselected value while allowing relative movement between the top chord 24 and the attachment plate 46 along a lateral direction when a lateral load greater than a preselected value is applied. In some embodiments, this can be chosen so that the connection will not slip during less significant loads, such as wind loads, but will slip before a seismic load is high enough to damage the truss members. While slotted holes 48 are provided in the attachment plate 46 and standard holes 66 are provided in the beam flange 52 in the illustrated embodiment of FIG. 3A, it will be appreciated that in other embodiments the holes 66 can be provided in the attachment plate 46 and the slotted holes 48 can be provided in the beam flange 52, as shown in FIG. 3B.

The slip joint 46 may also include a compression member 76 for balancing the load from diagonal web member 40 once slipping is initiated. The compression member 76 can be any member, such as a steel member, capable of compression load. The compression member 76 is positioned in-between adjacent vertical web members 38, and can be welded or otherwise connected thereto. In some embodiments, the compression member 76 is installed as close as possible to attachment plate 46 so that extra bending is not induced in vertical web member 38. In that regards, many configurations are possible in order to prevent interference with bolts 68. Depending on the applied loads, some embodiments of the compression member 76 will include a tube member to minimize its size, a "T" member to minimize its interference with bolts 68, etc. It will be appreciated that gusset plates and/or the like may be employed in a conventional manner to assist in connecting the web members 38, 40 and the compression member 76 of the truss 20.

Figure 5:
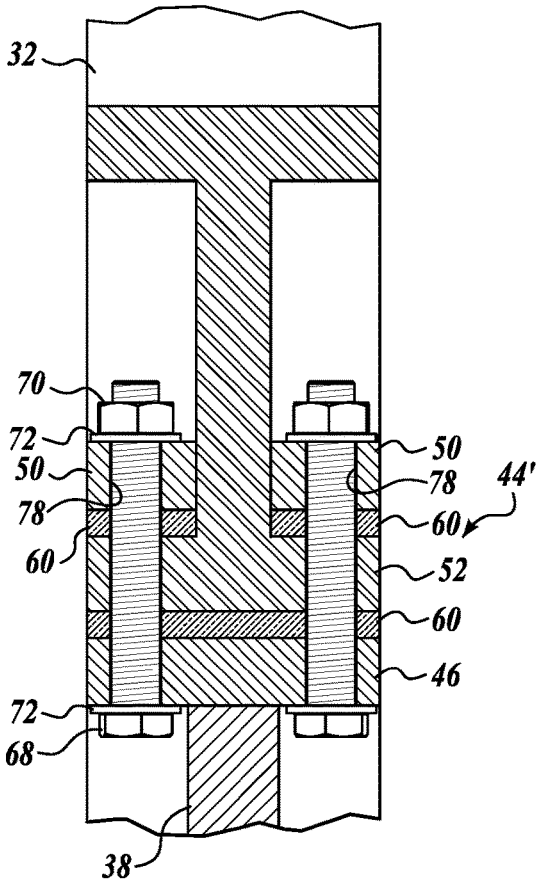
FIG. 5 is a cross-sectional view of another example of a slip joint formed in accordance with aspects of the present disclosure.

As described above, the slip joint 44 is configured as an "asymmetrical" connection since the top chord slips with respect to the attachment plate 46 over one surface. It will be appreciated that the slip joint 44 in other embodiments can be configured as a "symmetrical" connection. In that regard, please refer to FIG. 5, where another embodiment of the slip joint, designated 44', is shown. In the embodiment of FIG. 5, additional cap plates 50 are placed on top of the beam flange 52 and secured by the fastener arrangement through laterally slotted holes 78. Shims 60 are disposed between the top surface of the beam flanges 52 and the bottom surface of the cap plates 50. In other embodiments, the cap plates 50 can be placed underneath the attachment plate 46, separated by shims 60, and retained by the fastener arrangement.

Figure 6:
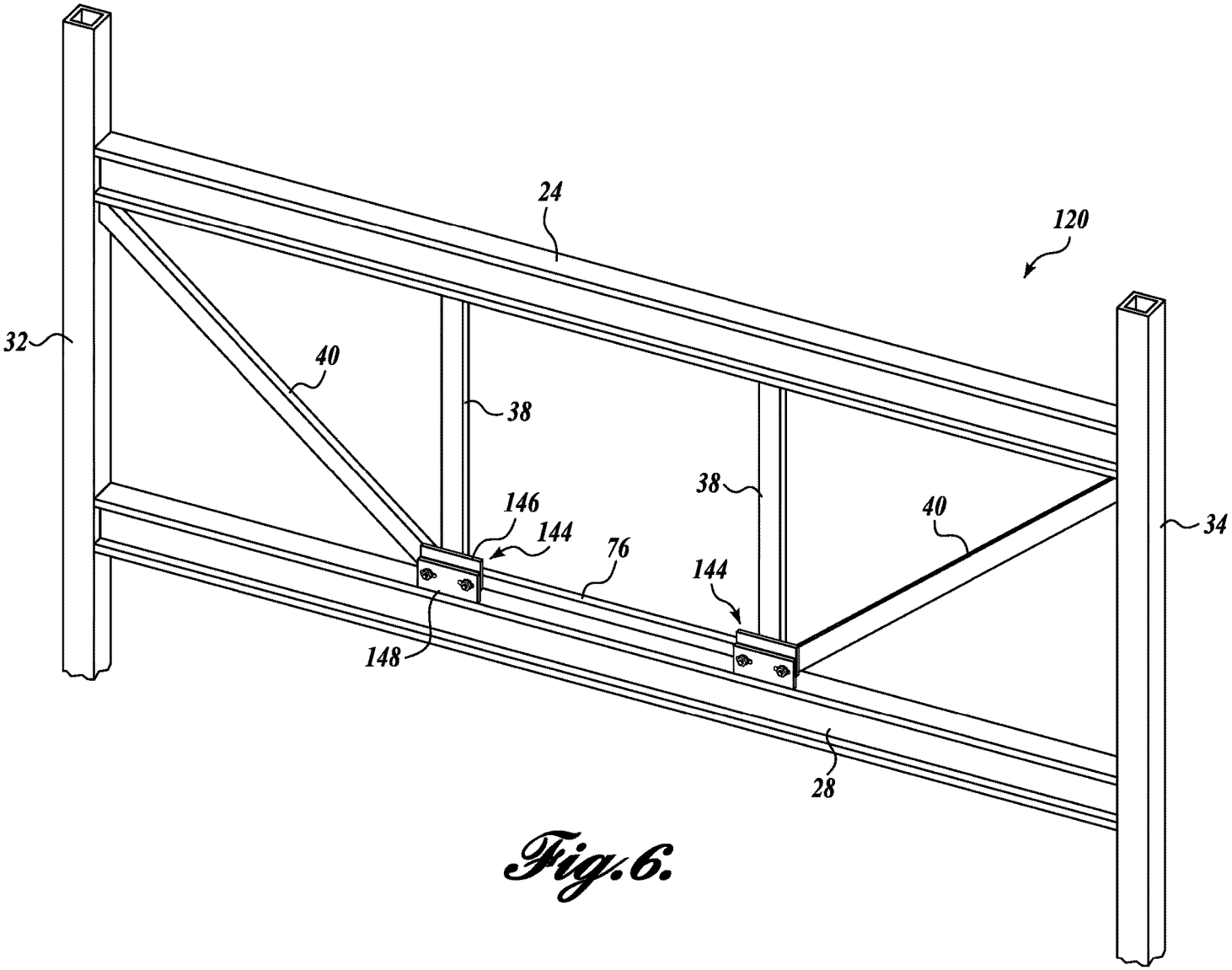
FIG. 6 is another example of a slip joint formed in accordance with aspects of the present disclosure, the slip joint of FIG. 6 being suitable for use with the bottom chord of a truss.

While the embodiments heretofore described have employed a slip joint 44 at the top chord 24, slip joints at the bottom chord can also be employed. In that regard, turning now to FIG. 6, there is shown another example of a slip joint 144 suitable for use at the bottom chord 28 of a truss 120. In the embodiment shown in FIG. 6, the slip joint 144 includes a vertically oriented top attachment plate 146A welded or otherwise fixedly connected to the end sections of the vertical web member 38 and/or the diagonal web members 40. The slip joint 144 also includes a vertically oriented bottom attachment plate 146B that is welded or otherwise fixedly connected to the top of bottom chord 28. A piece of shim 60 is disposed in-between the vertically oriented top and bottom attachment plates 146A and 146B, as best shown in the cross-sectional view of FIG. 7A. In the embodiment shown, the shim 60 and the bottom attachment plate 146B include aligned, laterally slotted holes 64 and 48B, while the top attachment plate 146A includes holes 54. A fastener arrangement of bolts 68, nuts 70, and optional washers 72 are inserted through respective slotted holes 48B and 64, and through holes 54, in order to connect the top attachment plate 146A to the bottom attachment plate 146B. In this embodiment, the compression member 76 can be disposed between the adjacent vertical members 38.

When assembled, the tension placed on the bolts 68 can be selected to work with the coefficient of friction in the shim 60 so that the top attachment plate 146A is prohibited to move relative to the bottom attachment plate 146B when an applied lateral load is less than a preselected value while allowing relative movement between the top attachment plate 146A and the bottom attachment plate 146B along a lateral direction when a lateral load greater than a preselected value is applied.

FIGS. 7A-7G illustrate several another examples of slip joints formed with various configurations of the top and bottom attachment plates 146A and 146B, which may be practiced with embodiments of the present disclosure. Similar to the embodiment described above, the examples in FIGS. 7A-7G employ fastener arrangements, such as bolt 68, nut 70, and optional washer 72, in conjunction with laterally slotted holes in order to connect the top and bottom attachment plates 146A and 146B unless described or shown otherwise. In the embodiment of FIG. 5A, the top and bottom attachment plates 146A and 146B interface with the shim 60 at generally vertically oriented, planar surfaces. In FIG. 5B, side plates 98 are disposed on the front and back surfaces of the top and bottom attachment plates 146A and 146B. In this embodiment, the shims 60 are position in between the top and bottom attachment plates 146A and 146B and the side plates 98, respectively. In FIGS. 7C-7D, FIGS. 7E and 7G, and FIG. 7F, the top and bottom attachment plates 146A and 146B defined cooperating stepped (FIGS. 7C-7D), channeled (FIGS. 7E and 7G), or toothed (FIG. 7F) surfaces for interfacing with the shims 60.

Figure 8:
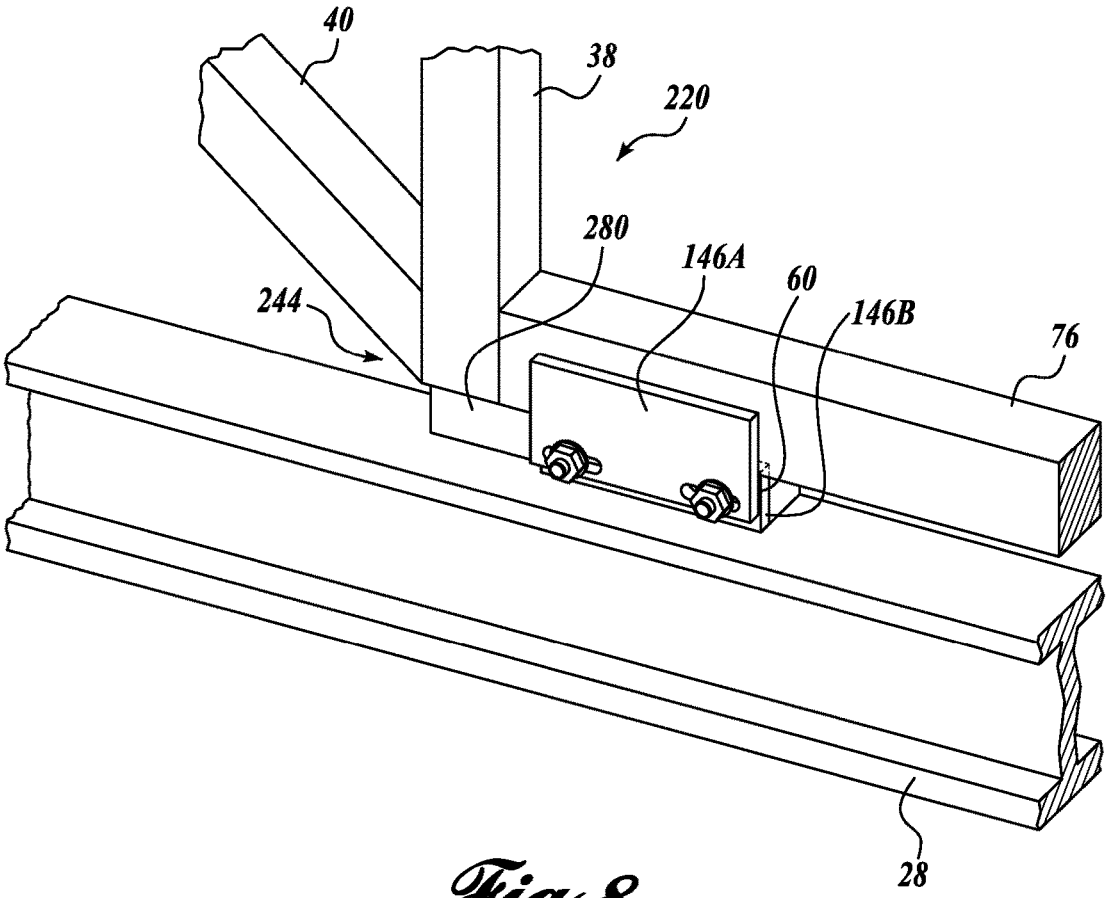
FIG. 8 is another example of a slip joint formed in accordance with aspects of the present disclosure, the slip joint of FIG. 8 being suitable for use with the bottom chord of a truss.

FIG. 8 illustrates another example of the slip joint 244 suitable for use at the bottom chord 28 of a truss 220. The slip joint 244 is substantially identical to the slip joint 144 of FIG. 6 except for the differences that will now be described. As best shown in FIG. 8, the top and bottom attachment plates 146A, 146B are positioned laterally offset with respect to the vertical web member 38 along the compression member 76. A vertical knife plate or other support post 280 can be disposed in a supporting relationship between the bottom chord 28 and the vertical web member 38 in order to support the vertical member 38. As such, the bolts 68 in this embodiment are no longer side bearing.

Figure 9:
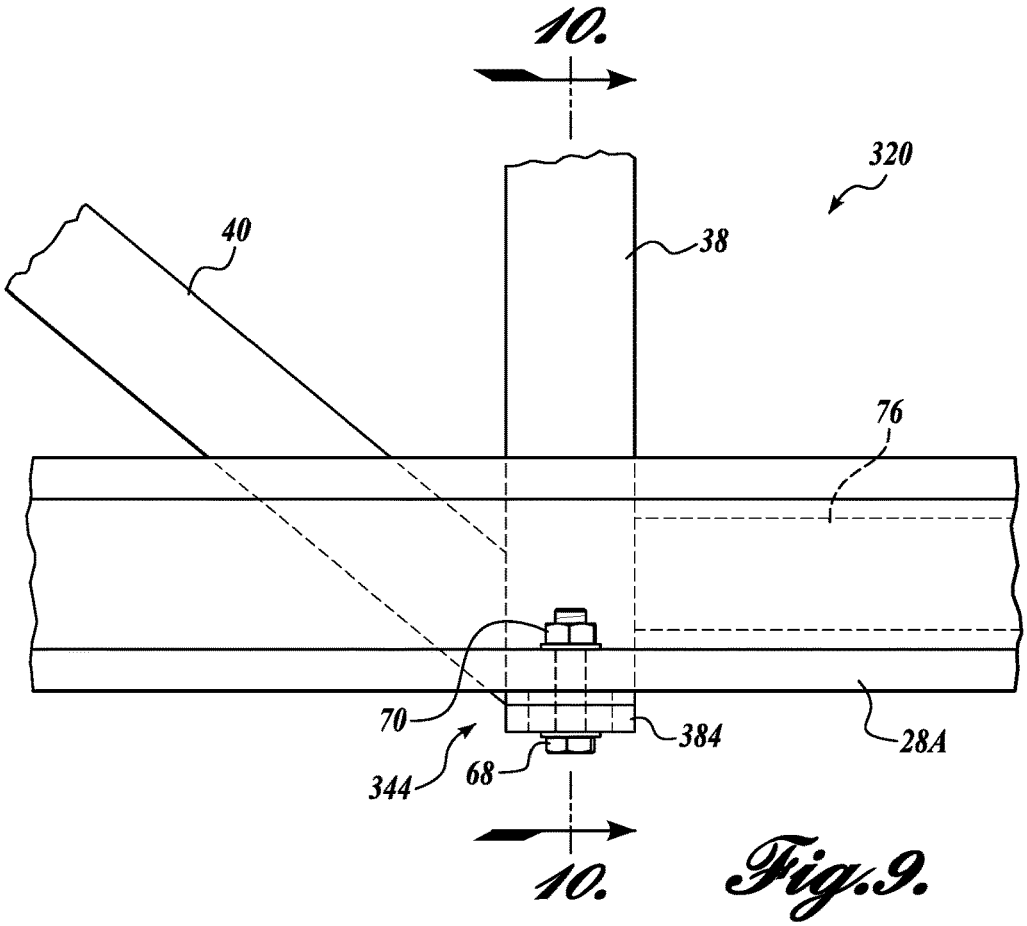
FIG. 9 is a side view of yet another example of a slip joint formed in accordance with aspects of the present disclosure, the slip joint of FIG. 9 being suitable for use with the bottom chord of a truss.
Figure 10:
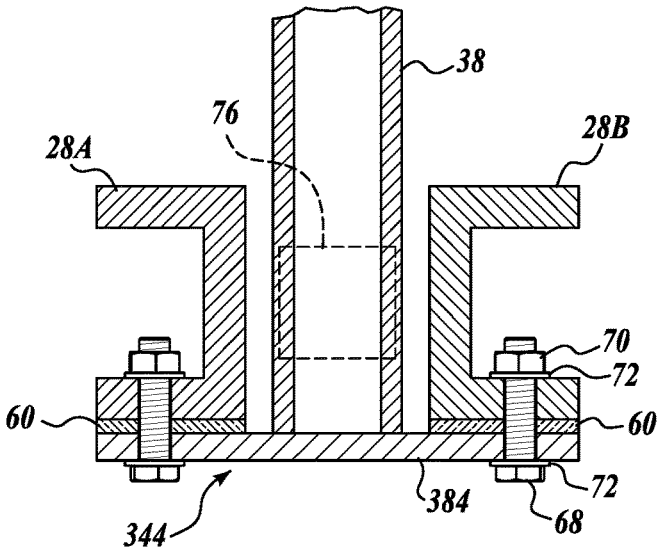
FIG. 10 is a cross sectional view of the slip joint of FIG. 9.
Figure 11:
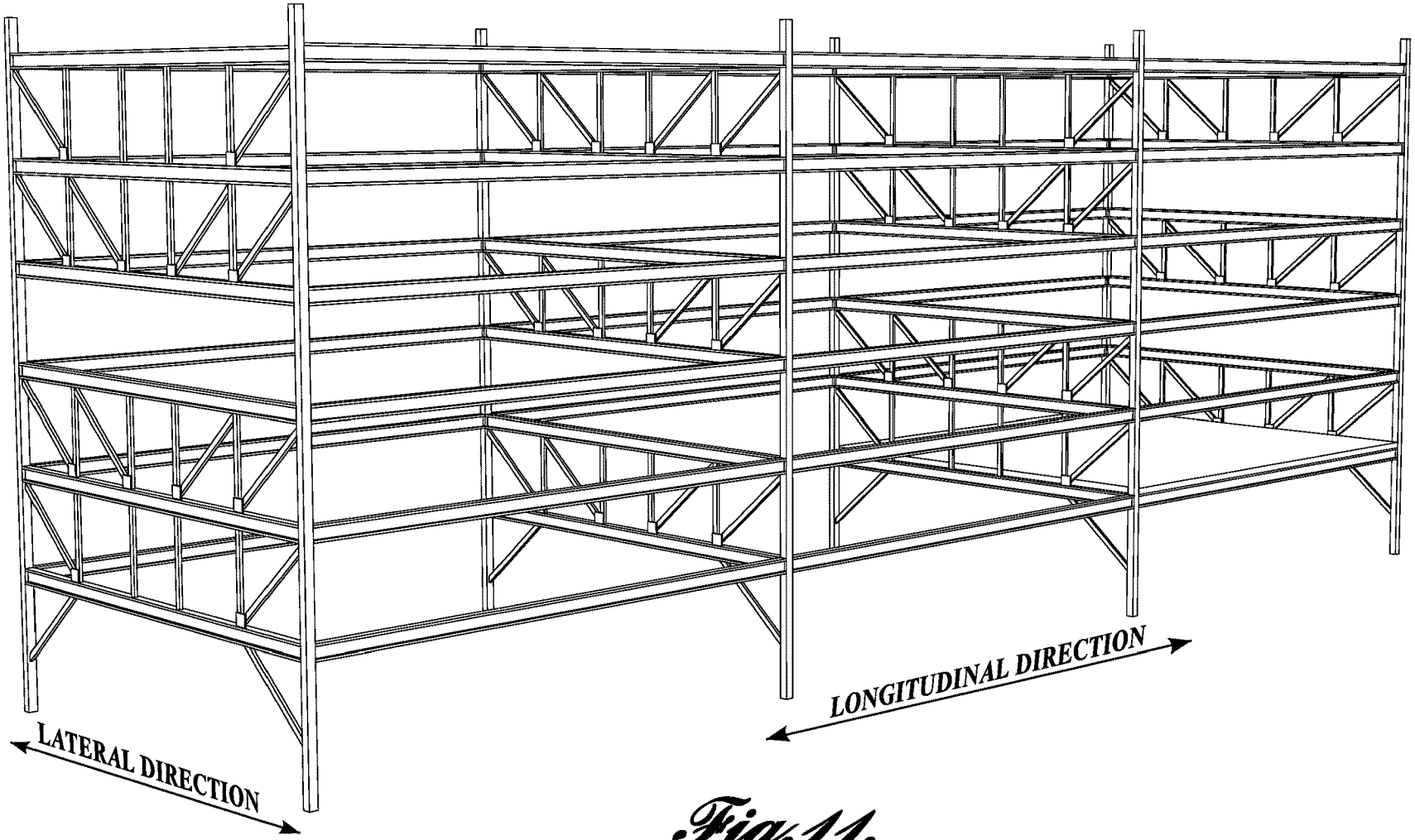
Fig. 11. (PRIOR ART)
FIG. 11 is a perspective view of a conventional SSTS.

FIGS. 9-10 depict yet another example of a slip joint 344 suitable for use at the bottom chord 28 of a truss 320. As best shown in FIG. 10, the bottom chord 28 includes first and second beams 28A and 28B, such as U-beams, positioned on the lateral sides of the vertical web member 38. A support plate 384 is welded or otherwise fixedly connected to the bottom of the vertical web member 38. The support plate 384 extends laterally below the first and second beams 28A and 28B. Shims 60 are disposed in-between the support plate 384 and the first and second beams 28A and 28B. Similar to the embodiments described above, the shim 60 and the support plate 384 include aligned, laterally slotted holes while the flanges of the first and second beams 28A and 28B include regular holes. A fastener arrangement of bolts 68, nuts 70, and optional washers 72 are inserted through respective slotted holes in the shim 60 and support plate 384 and holes in the first and second beams 28A and 28B in order to connect the first and second beams 28A and 28B to the support plate 384. In this embodiment, the compression member 76 can be disposed between the adjacent vertical members 38. In other embodiments, the compression member 76 can be positioned below the bottom chord 28 and disposed between the adjacent support plates 384.

In some embodiments of the present disclosure, components of the truss, such as the web members and the top and bottom chords are constructed out of steel, although other materials may be practiced in some embodiments of the present disclosure. Similarly, in some embodiments of the present disclosure, shims 60 may be constructed out of high strength steel, particularly Bisplate 500. Other materials can be used for the shims 60 including mild steel, stainless steel, brass, such as naval brass and shell casing brass, Babbitt metal, brake pad liner material, aluminum, etc, the choice of which can be made, in part, on its attended application. The surfaces of the shims may be varied (e.g., textured, etc.) in order to increase its coefficient of friction. If seismic isolation is desired, rather than seismic protection, shims of PTFE, high density polypropylene, high density polyethylene, or similar low friction materials can be used. In some embodiments, the bolts are grade A325 high strength bolts, although other grade bolts may be used. To obtain the specific tension to maintain the desired initiation of slip, bolts may be installed with the turn-of-the-nut-method, with load indicating washers, or with special load indicating bolts, and/or the like. In some attended applications, it will be appreciated that one or more parameters of the truss, including slot size, bolt size, truss component materials, etc., will be determined, in part, by local building codes.

It should be noted that for purposes of this disclosure, terminology such as "upper," "lower," "vertical," "horizontal," "fore," "aft," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A truss for use in a staggered truss system, comprising:

a top chord extending in a first direction and having a first and a second end;

a bottom chord spaced from the top chord and extending in parallel with the top chord;

at least one vertical web member positioned between the top and bottom chord and inwardly of the first or the second end of the top chord;

at least one diagonal web member positioned between the top and bottom chord; and at least one slip joint positioned at an interface of the top chord and the at least one vertical web member, the slip joint configured to connect the top chord to the at least one vertical web member in a manner that prohibits relative movement between the top chord and the vertical web member along the first direction when a load less than a preselected value is applied while allowing relative movement between the top chord and the vertical web member along the first direction when a load greater than a preselected value is applied, wherein the at least one slip joint includes:

an attachment plate secured to the top of the vertical web member, the attachment plate positioned underneath a section of the top chord;

a shim positioned between the attachment plate and the section of the top chord, the shim having a coefficient of friction and a plurality of slots elongated in the first direction; and a fastener arrangement configured to connect the top chord to the attachment plate, wherein one of the attachment plate or the section of the top chord include a plurality of slots generally sized and aligned with the slots of the shims and the other of the attachment plate and the section of the top chord includes a plurality of holes, and wherein the fastener arrangement includes a plurality of bolts that extend through the generally aligned slots and the holes and a plurality of nuts that affix the plurality of bolts in place.

2. The truss of claim 1, wherein the slip joint includes:

an attachment plate secured to the top of the vertical web member, the attachment plate positioned underneath a section of the top chord;

a shim positioned between the attachment plate and the section of the top chord, the shim having a coefficient of friction; and a fastener arrangement configured to connect the top chord to the attachment plate, wherein the shim and one of the attachment plate and the section of the top chord include at least one slot elongated in the first direction and generally aligned with one another, and wherein the fastener arrangement includes a bolt that extends through the generally aligned slots and a hole in the other of the one of the attachment plate and the section of the top chord and a nut that affixes the bolt in place.

3. The truss of claim 2, wherein the bolt translates within the elongated slots as the top chord slips along the first direction with respect to the attachment plate.

4. The truss of claim 2, wherein the nut and bolt are cooperatively tensioned so that the top chord slips along the first direction with respect to the attachment plate when a load greater than a preselected value is applied.

5. The truss of claim 4, wherein the tension applied by the nut and bolt and the shim material are selected so that the top chord slips along the first direction with respect to the attachment plate when a load greater than a preselected value is applied.

6. The truss of claim 5, wherein the preselected value is dependent on loads generated in seismic events.

7. The truss of claim 1, further including a second vertical web member spaced from the first vertical web member, and a compression member disposed between the first and second vertical web members.

8. The truss of claim 7, wherein the compression member is disposed adjacent the attachment plate.

9. The truss of claim 1, wherein the nut and bolt are cooperatively tensioned so that the top chord slips along the first direction with respect to the attachment plate when a load greater than a preselected value is applied.

10. The truss of claim 1, wherein the bolt translates within the elongated slots as the top chord slips along the first direction with respect to the attachment plate.

11. The truss of claim 1, further including a second vertical web member spaced from the first vertical web member, and a compression member disposed between the first and second vertical web members.

12. The truss of claim 11, wherein the compression member is disposed adjacent the attachment plate.

* * * * *